US007320353B1

(12) United States Patent
Miller et al.

(10) Patent No.: US 7,320,353 B1
(45) Date of Patent: Jan. 22, 2008

(54) RETRACTABLE SCREEN FOR STRUCTURAL OPENINGS

(76) Inventors: Marvin F. Miller, 2458 Arbor Lake La., #814, Indianapolis, IN (US) 46268; Carolyn Miller, 2458 Arbor Lake La., #814, Indianapolis, IN (US) 46268

( * ) Notice: Subject to any disclaimer, the term of this patent is extended or adjusted under 35 U.S.C. 154(b) by 415 days.

(21) Appl. No.: 10/899,261

(22) Filed: Jul. 26, 2004

Related U.S. Application Data

(63) Continuation-in-part of application No. 09/840,495, filed on Apr. 24, 2001, now abandoned.

(51) Int. Cl.
*E06B 3/00* (2006.01)

(52) U.S. Cl. ..... 160/89; 160/368.1

(58) Field of Classification Search ..... 160/89, 160/84.01, 180, 368.1, 327, 354, 90; 135/117
See application file for complete search history.

(56) References Cited

U.S. PATENT DOCUMENTS 1,482,978 A * 2/1924 Edwards ..... 160/84.01
3,004,592 A * 10/1961 Norton ..... 160/114
3,478,805 A * 11/1969 Haggard ..... 160/5
4,760,980 A * 8/1988 Sharpe ..... 245/2
5,271,449 A * 12/1993 Herrick ..... 160/368.1
5,323,835 A * 6/1994 Bachmeier ..... 160/89
5,427,169 A * 6/1995 Saulters ..... 160/368.1
5,680,893 A * 10/1997 Neer ..... 160/330
6,079,473 A * 6/2000 Ackerson et al. ..... 160/368.1
6,257,307 B1 * 7/2001 Tollivar ..... 160/368.1
2002/0134518 A1 * 9/2002 Anderson ..... 160/265

* cited by examiner

*Primary Examiner*—Blair M. Johnson

(57) ABSTRACT

A retractable screen is provided for covering a structural opening by mounting it within the opening. The screen comprises a screen panel, first mounting means for mounting the side edges of the screen panel, and second mounting means for mounting the top edge of the screen panel. The first mounting means is further selectively releasably secured to the respective side edges of the screen panel by zipper means such that unfastening the zipper means at both side edges permits the screen panel to be retracted generally upwardly while the mounting means remain generally in place.

26 Claims, 9 Drawing Sheets

RETRACTABLE SCREEN FOR STRUCTURAL OPENINGS

This application is a Continuation-In-Part claiming the benefit of U.S. patent application Ser. No. 09/840,495 entitled "Garage Door Screen and Installation Method," filed on Apr. 24, 2001 now abandoned, the entire disclosure of which is incorporated by reference herein.

BRIEF DESCRIPTION DRAWINGS

DETAILED DESCRIPTION OF EMBODIMENTS OF THE INVENTION

Figure 1:
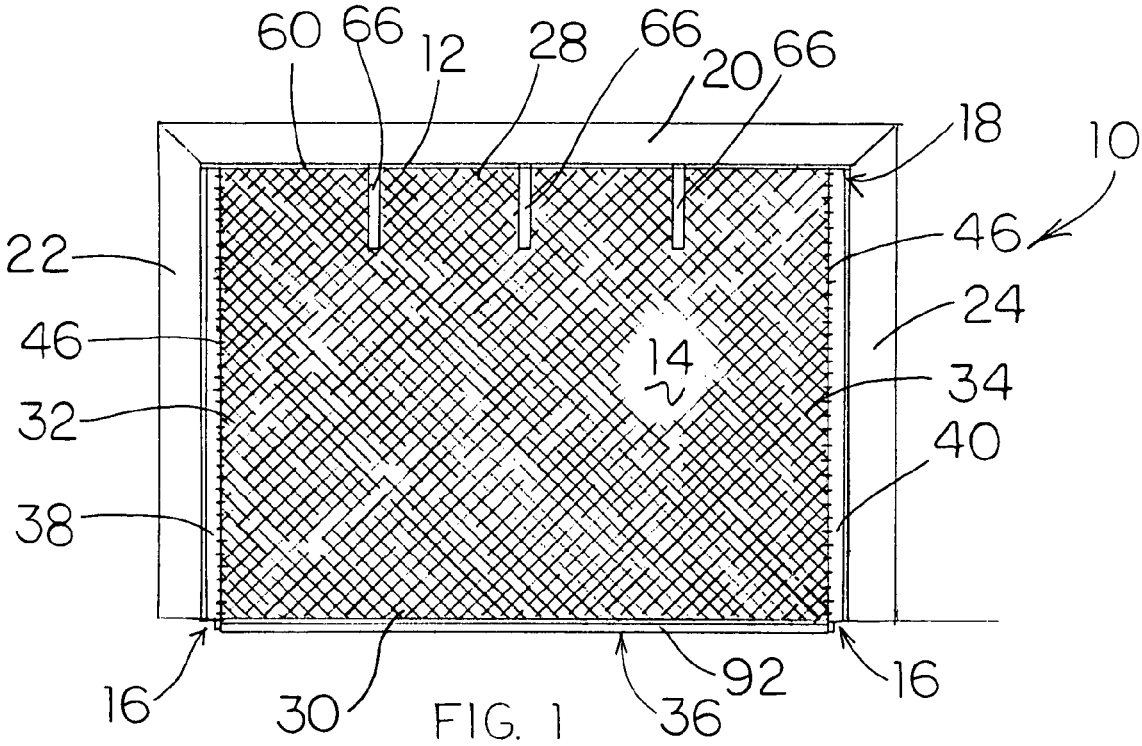
FIG. 1 illustrates a front view of one version of the retractable screen of the present invention mounted within an opening with the screen panel in a normal position.

Although the disclosure hereof is detailed and exact in order to enable those skilled in the art to practice the invention, the physical versions herein disclosed merely exemplify the invention which may be embodied in other specific structure. The scope of the invention is defined in the claims appended hereto.

Referring now to the drawings, versions of a retractable screen 10 are illustrated and described herein that are configured for mounting in a structural opening 12. The screen 10 generally comprises a screen panel 14 and first and second mounting means 16, 18 for mounting the screen 10 in the opening 12. The screen panel 14 is generally manufactured of conventional synthetic, such as nylon, or metal screening mesh that permits the passage of light and the flow of air and smoke therethrough but generally prevents bugs and other small objects from passing through the opening 12.

The opening 12 generally is defined at least partially by a top member 20 and first and second side members 22, 24. An example of an opening 12 suitable for use with the present invention is a doorway, such as for a garage door. Such an opening 12 is further defined at the bottom by the floor or the ground surface 26. Other examples of suitable openings 12 will be apparent to those skilled in the art and are intended to be included within the scope of this disclosure. For purposes of simplicity and example, the opening 12 in this disclosure may be referred to as a door opening, but such reference is not intended to limit the scope hereof or the claims appended hereto.

As shown in FIG. 1, in one version the screen panel 14 has a top edge 28, a bottom edge 30, and first and second side edges 32, 34. The first mounting means 16 is provided generally proximate the first and second side edges 32, 34, and the second mounting means 18 is provided generally proximate the top edge 28. The bottom edge 30 is generally without mounting means but the screen panel 14 may be provided with sufficient height from the top edge 28 to the bottom edge 30 such that the bottom edge 30 substantially contacts the floor or ground surface 26 that further defines the opening 12. The bottom edge 30 generally comprises a footer 36 provided substantially therealong.

In one version, the screen panel 14 is generally configured to extend between the first and second mounting means 16, 18 such that the screen panel 14 substantially covers the opening 12. In a garage door application of the present invention, the retractable screen 10 thus permits use of the garage space with a garage door (not shown) generally raised or open so that light and air from the outside may come in while preventing bugs, rodents or other pests from entering.

Figure 2:
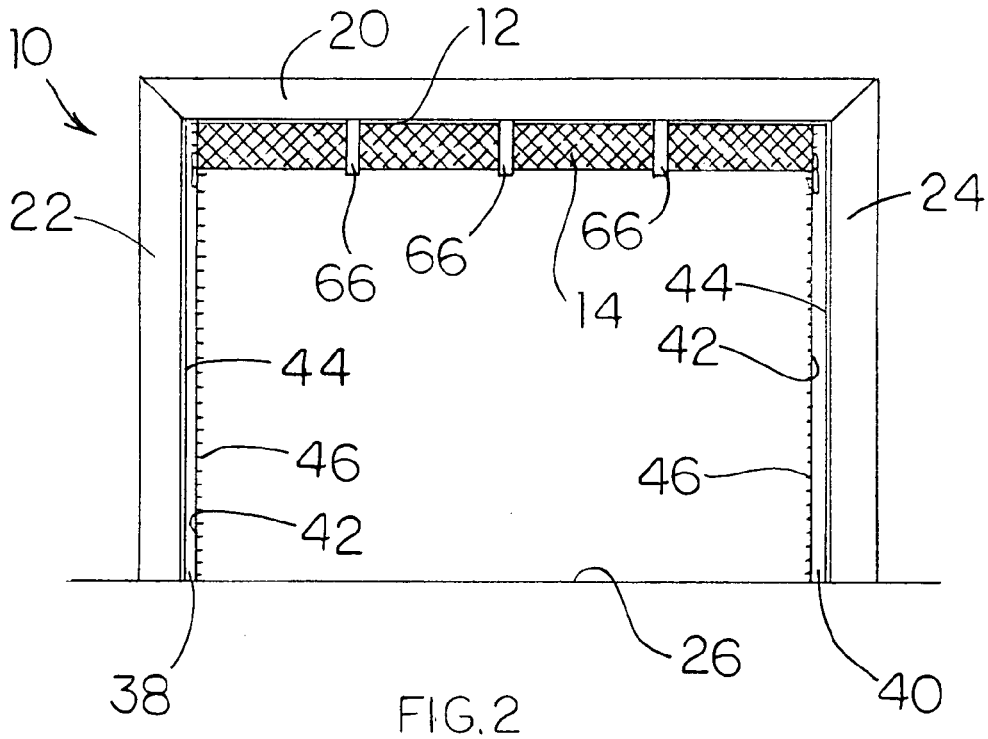
FIG. 2 illustrates a front view of the retractable screen of FIG. 1 with the screen panel in a retracted orientation.
Figure 3:
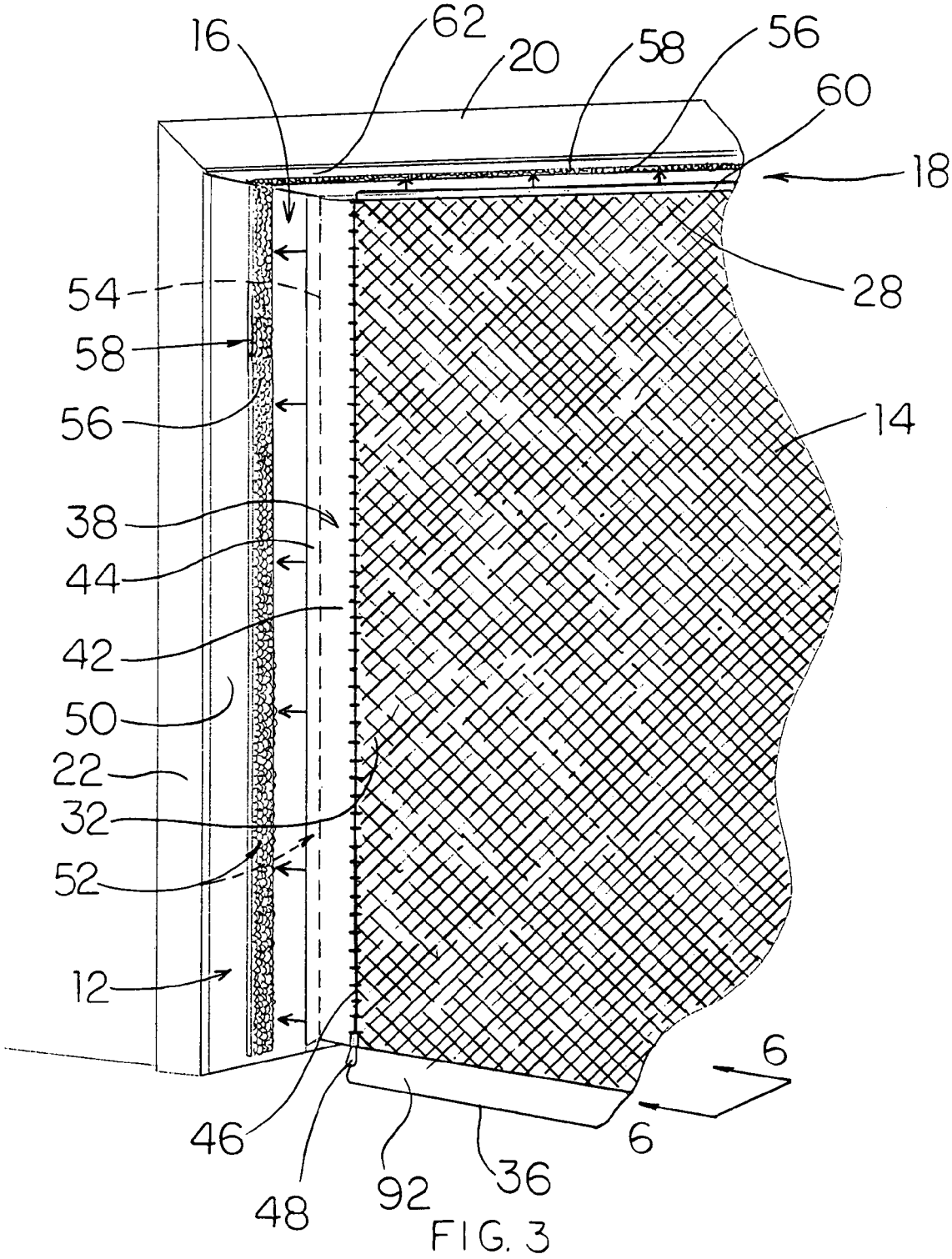
FIG. 3 illustrates a partial perspective view of one version of the retractable screen showing the orientation of the first mounting means prior to engagement of the fastener for mounting the outer edge of one mounting flap to the inwardly facing surface of one side member.
Figures 4, 5, 6, 7:
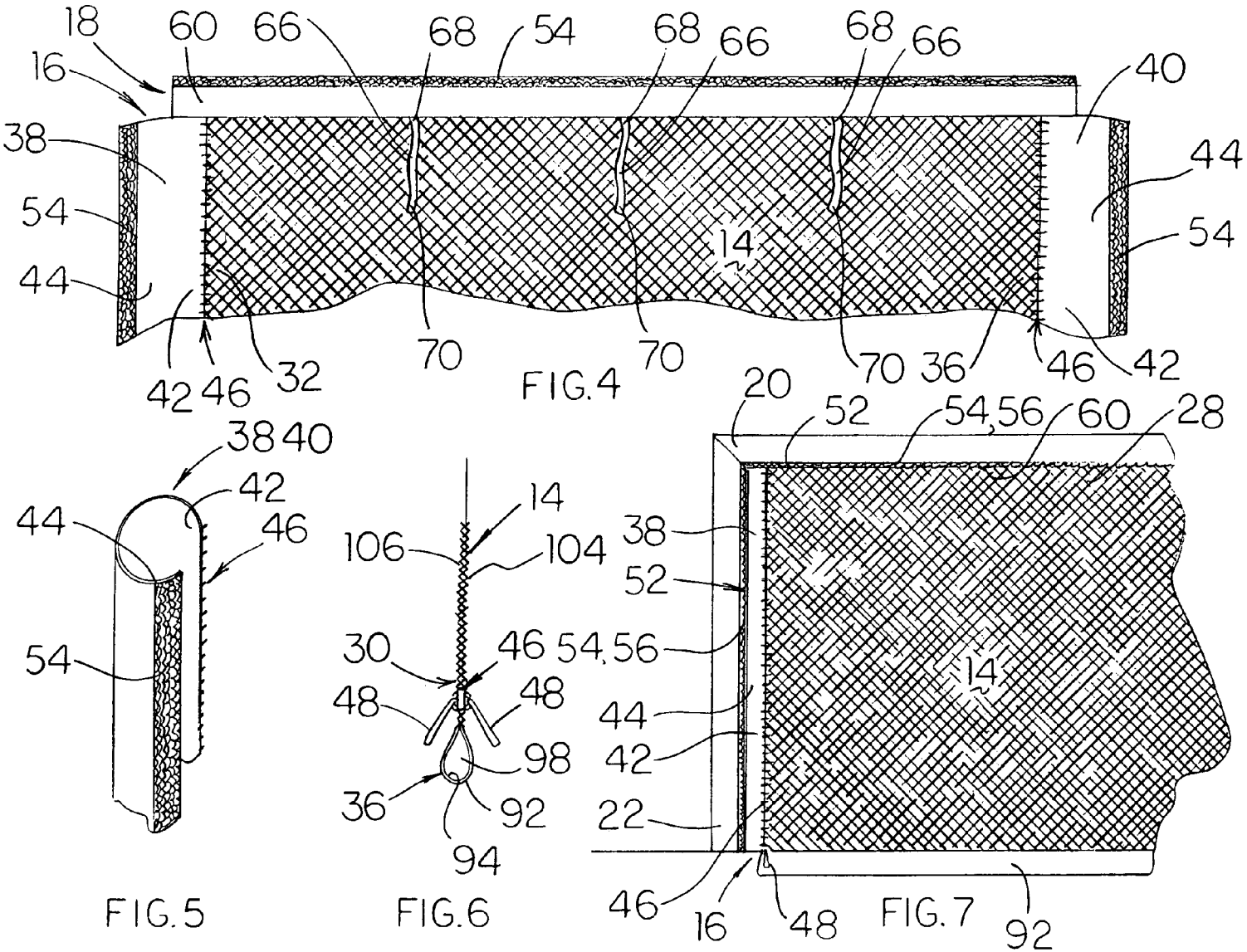
FIG. 4 illustrates a partial front view of one version of the retractable screen showing the second mounting means proximate the top edge of the screen panel.
FIG. 5 illustrates a partial perspective view of one version of a mounting flap, demonstrating the flexible nature of the material of the flap.
FIG. 6 illustrates a cross sectional view of the lower portion of one version of the retractable screen along the line 6-6 in FIG. 3.
FIG. 7 illustrates a front close-up view of one side of a version of the retractable screen mounted within an opening.

As shown in FIGS. 1-3, in one version, first mounting means 16 comprises first and second flexible mounting flaps 38, 40 provided proximate the first side edge 32 and second side edge 34, respectively. Each mounting flap 38, 40 in other versions comprises an inner edge 42 and an outer edge 44 as shown in greater detail in FIGS. 3 and 5. In yet other versions, each mounting flap 38, 40 is adapted for flexible and resilient manipulation such that the inner edge 42 and outer edge 44 of the flap 38, 40 can be folded over on each other, such as illustrated in FIG. 5. The flaps 38, 40 may be manufactured of a durable nylon ribbon, such as is conventionally used for automobile seat belts and other flexible and durable straps. In one version, each flap 38, 40 is from about one-half inches to about four inches in width.

Referring now to FIG. 3 which focuses on the first mounting means 16 proximate the first side edge 32 but which configuration is generally same regarding the second side edge 34 and second mounting flap 40, in one version the inner edge 42 of the first mounting flap 38 is selectively releasably connected to the first side edge 32 of the screen panel 14 by a zipper means 46. Zipper means being generally known, a person of ordinary skill in the art will appreciate and understand that various teeth sizes, quality, and durability characteristics may be selected for the zipper means 46 as desired or depending on the particular application for the retractable screen 10 described herein. In one version of the screen 10 used for a garage door opening, the zipper means 46 has a relatively high durability and may comprise a double zipper having a pull tab 48 on both sides of the zipper means 46. In other versions, as shown in FIG. 3, the zipper means 46 is provided so that the inner edge 42 of the first mounting flap 38 is selectively releasably connected to the first side edge 32 of the screen panel 14 when the pull tab 48 of the zipper means 46 is pulled downwardly to a position proximate the bottom edge 30.

Outer edges 44 of the mounting flaps 38, 40 are generally configured for mounting to the inwardly facing surfaces 50 of the side members 22, 24 defining the opening 12. In one version, the outer edges 44 are so mounted by a hook-and-loop fastener 52, for example Velcro® brand fasteners. As shown in FIG. 3, in other versions, one portion 54 of the fastener 52 is secured proximate the outer edge 44 substantially along the length of the first mounting flap 38. In yet other versions, the complimentary portion 56 of the fastener 52 is provided on a strip 58 that is secured to the inwardly facing surface 50 of each of the side members 22, 24. In yet other versions, the strip 58 comprising the complimentary portion 56 is provided substantially along the length of each side member 22, 24, the one portion 54 having generally the same length as the strip 58 of the complimentary portion 56, and thus providing a substantially complete connection of the fastener 52 for mounting each side edge 32, 34 of the screen panel 14 to substantially the whole respective side members 22, 24 of the opening 12. In yet other versions, the strips 58 are secured to the inwardly facing surfaces 50 by one or more of a suitable adhesive, tacks, nails, and other conventional securing means.

The second mounting means 18 is provided for mounting the top edge 28 to the top member 20 defining the opening 12. In one version, the second mounting means 18 comprises a top mounting border 60 secured proximate to the top edge 28. Referring now to FIGS. 3 and 4, in other versions, one portion 54 of a hook-and-loop fastener 52 is secured substantially along the top mounting border 60 and a complimentary portion 56 of such a fastener 52 is secured to an inwardly facing surface 62 substantially along the top member 20, thus providing a substantially complete connection of the fastener 52 for mounting the top edge 28 to substantially the whole top member 20 of the opening 12.

A person of ordinary skill in the art will appreciate that the one portion 54 and complimentary portion 56 of a hook-and-loop fastener 52 are generally interchangeable, and no specific claim or description herein shall require that either the "hook" or "loop" portions be on the strips 58 secured to the inwardly facing surfaces 50, 62 or to the first or second mounting flaps 38, 40 or top mounting border 60. Such determinations are often dependent on manufacturer preferences for makers of hook-and-loop fasteners 52, one particular portion of a fastener being manufactured in a way that is more suitable for receiving an adhesive backing or being sewn or otherwise secured to the outer edge 44 or top mounting border 60. For example, Velcro® brand sells one version of the fastener 52 in strips in which the "loop" portion has an adhesive backing and the "hook" portion has only a fabric backing for sewn attachment to a member. Other versions provide both portions 54, 56 in strips 58 with adhesive backing, in which case either strip may be adhesively secured to the surfaces 50, 62 or sewn onto the outer edge 44 of the mounting flap 38, 40 or onto the top mounting border 60.

In use, the strips 58 comprising the complimentary portions 56 of the fastener 52 are secured to the inwardly facing surfaces 50, 62 of the top member 20 and the first and second side members 22, 24. Although in certain applications the strips 58 may be provided on external or internal faces of the members 20, 22, 24 defining the opening 12, certain benefits of the disclosed versions of the present invention are more greatly realized by mounting the screen 10 within the opening 12 rather than on one side or the other of the opening 12. For example, in the garage door context, the garage door itself generally closes the opening by sealing up against the internal faces of the members 20, 22, 24, i.e. on the interior side of the opening 12. This circumstance would require the screen 10 to be disassembled each time the door is to be closed if the strips 58 were secured to such internal faces. While the same may not be so regarding the external faces of the members 20, 22, 24, i.e. on the exterior side of the opening 12, the strips 58 in such a position may be unsightly or the external faces may have ornamentation or contouring that makes such securement difficult or otherwise impossible.

The strips 58 thus being secured to inwardly facing surfaces 50, 62, i.e. within the opening 12, the first and second mounting means 16, 18 are engaged by pressing the one portion 54 of the fasteners 52 against the corresponding complimentary portions 56. Being so mounted, the retractable screen 10 generally covers the opening 12 when the zipper means 46 are selectively employed for connecting the inner edges 42 of the first and second mounting flaps 38, 40 to the respective first and second side edges 32, 34. The screen 10 is retractable by unfastening the zipper means 46 to disconnect the inner edges 42 from the respective side edges 32, 34, and retracting the screen panel 14 upwardly toward the top edge 28. The first and second mounting means 16, 18 thus remain generally in place while the screen panel 14 remains mounted only proximate the top edge 28.

Figure 8:
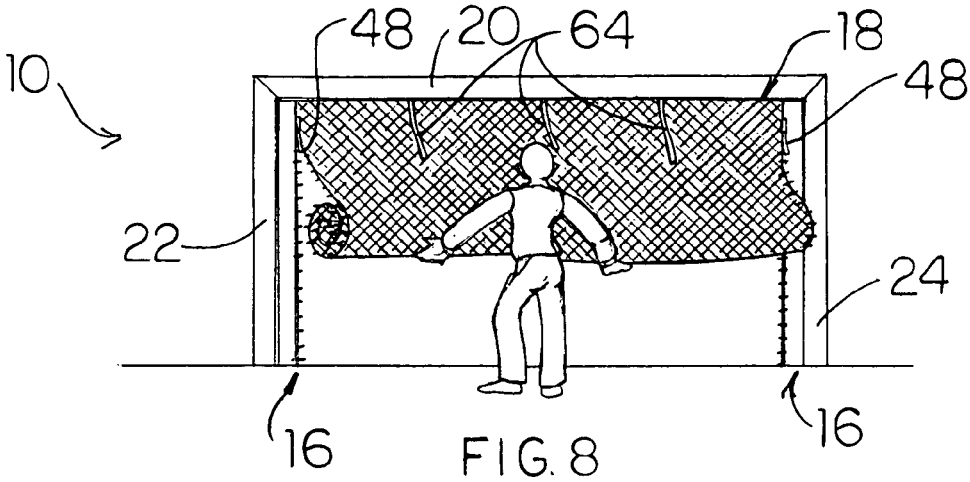
FIG. 8 illustrates a front view of a person retracting the screen panel of one version of a retractable screen mounted within an opening.
Figure 9A:
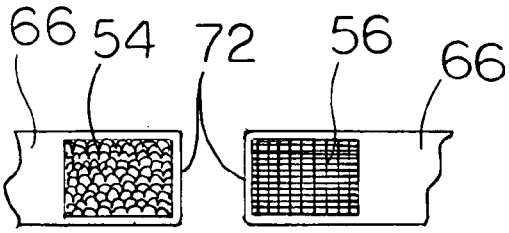
FIG. 9A illustrates a partial view of retention means comprising a pair of straps having a hook-and-loop fastener for securing the distal ends together.
Figure 9B:
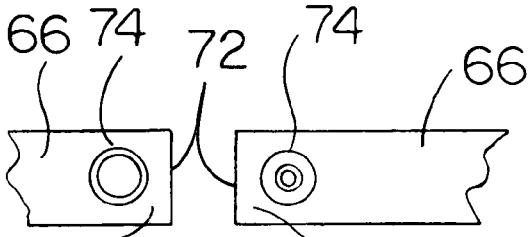
FIG. 9B illustrates a partial view of retention means comprising a pair of straps having a snap fastener for securing the distal ends together.
Figure 9C:
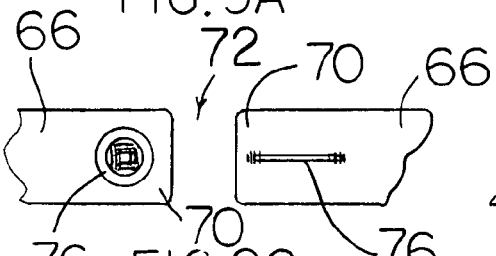
FIG. 9C illustrates a partial view of retention means comprising a pair of straps having a button fastener for securing the distal ends together.
Figure 9D:
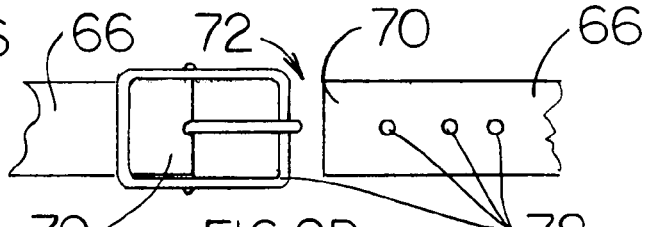
FIG. 9D illustrates a partial view of retention means comprising a pair of straps having a stem-and-eye buckle fastener for securing the distal ends together.
Figure 9E:
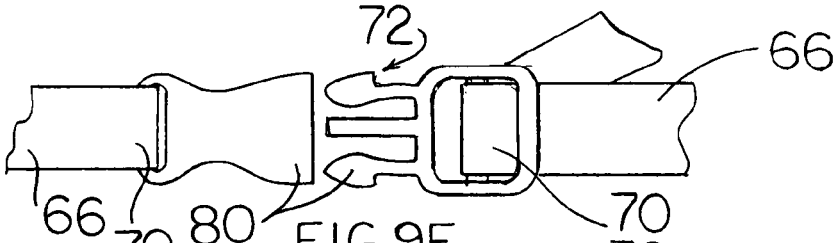
FIG. 9E illustrates a partial view of retention means comprising a pair of straps having a snap-in buckle fastener for securing the distal ends together.
Figure 9F:
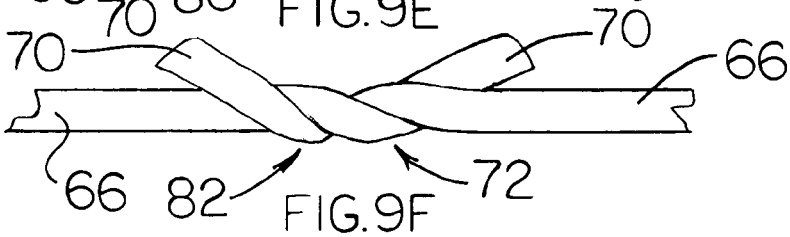
FIG. 9F illustrates a partial view of retention means comprising a pair of straps having distal ends that are tied together for securing them to each other.

In one version, the screen panel 14 is retracted by rolling the panel 14 upwardly, starting at the bottom edge 30 as shown in FIG. 8. A similar retraction may be accomplished by folding the panel 14 upwardly, again starting at the bottom edge 30. Referring now to FIG. 2, means 64 may be provided for retaining the panel 14 in a retracted orientation, for example to permit a car to enter or exit a garage without needing to remove the entire retractable screen 10 from within the opening 12. Such retention means 64 are configured to retain the retracted screen panel 10 proximate the top edge 28. In other versions, the retention means 64 comprises a plurality of pairs of straps 66 each secured at one end 68 proximate the top mounting border 60 and each having a distal end 70 hanging downwardly. Distal ends 70 in each pair of straps 66 have complimentary means 72 to secure themselves together with the screen panel 14 being in a retracted orientation and suspended between the straps 66. In yet other versions, the complimentary means 72 for securing the distal ends 70 together in each pair of straps 66 comprise retention fasteners such as hook-and-loop fasteners 52 (FIG. 9A), snaps 74 (FIG. 9B), buttons 76 (FIG. 9C), stem-and-eye buckles 78 (FIG. 9D), snap-in buckles 80 (FIG. 9E), and simple ties 82 (FIG. 9F).

Figure 16:
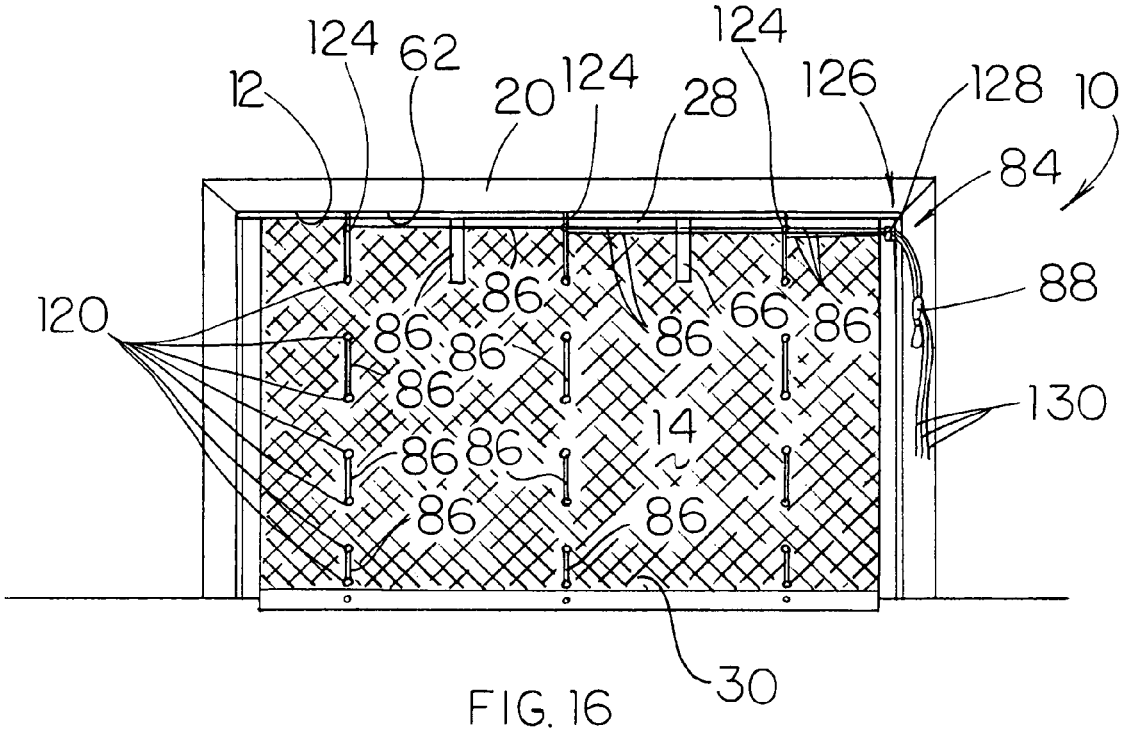
FIG. 16 illustrates a front view of a version of the retractable screen having retraction and retention means comprising a pulley system.
Figure 17:
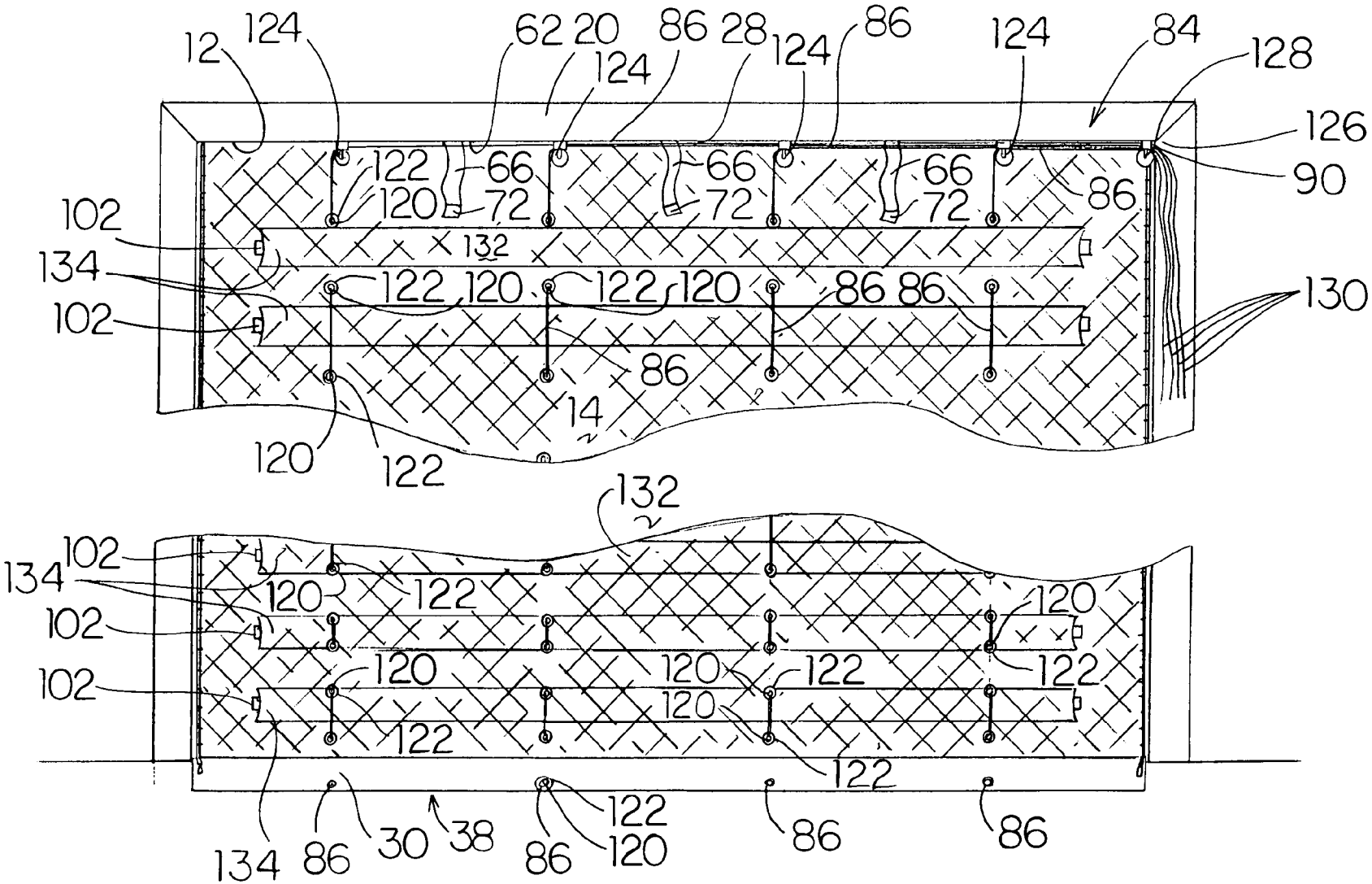
FIG. 17 illustrates a close-up view of another version of the retraction and retention means of FIG. 16.

Referring now to FIGS. 16-17, retraction and retention means 64 in one version comprises a pulley system 84 mounted proximate at the top edge 28 and configured to retractably roll or compress the screen panel 14 upwardly with a pull cord 86 operatively connected to the bottom edge 30. In one version, the pull cord 86 is maintained in a substantially pulled-out position by wrapping the length of the pull cord 86 around a cleat 88 mounted proximate the opening 12. In other versions, the pull cord 86 is maintained in such position by a set-friction brake 90.

Referring now to FIG. 16, a plurality of pull cords 86 are spaced apart and secured proximate the bottom edge 30 and extend wovenly upwardly therefrom towards the top edge 28. Each pull cord 86 is woven into the screen panel 14 through a plurality of generally aligned eyelets 120 extending from the interior face 104 to the exterior face 106 of the screen panel 14. In one version, plastic or metal grommets 122 are provided in the eyelets 120 for structural support thereof.

Generally directly above the line of each pull cord 86, a pulley 124 is secured on the inwardly facing surface 62 of the top member 20. The pulley 124 is configured to receive the pull cord 86 and redirect it generally perpendicularly toward a common corner 126 of the opening 12. In the corner 126, a primary pulley 128 is secured which is configured to receive each of the pulley cords 86 and redirects the distal ends 130 of each generally downwardly toward the floor surface 26. In one version, each pulley 124 and primary pulley 128 comprise conventional roller pulleys. In other versions, pulleys 124, 128 comprise an eye stem threadedly secured within the opening 12.

In order to retract the screen panel 14, a user pulls on the plurality of pull cords 86 approximate the distal ends 130. The bottom edge 30 is compressed upwardly by the pull cords 86 being secured thereto. In one version, the pull cords 86 are maintained in a desired pulled-out position by wrapping their lengths around cleat 88. In other versions, the pull cords 86 are maintained in the desired pulled-out position by a set-friction break 90 provided proximate or integral with the primary pulley 128. In yet other versions, the compressed screen panel 14 is additionally supported in a retracted orientation by being suspended between the straps 66 having the distal ends 70 secured together by the version of complimentary means 72 provided thereon.

Referring now to FIG. 17, in one version, means are included in the screen panel 14 for providing rigidity thereto during the operation of the pulley system 84. A plurality of transverse sleeves 132 are secured to one of the faces 104, 106 of the screen panel 14. Sleeves 132 are open at each end 134 and are generally configured to receive a rigid member 102 therein. Pulley cords 86 in one version are woven around the sleeves 132. In other versions, eyelets 120 are provided in one or more of the sleeves 132 for weaving the pull cords 86 therethrough but leaving room for the rigid member 102 to be inserted therein. In operation, the rigidity provided by placing members 102 within transverse sleeves 132 prevents the screen panel 14 from sagging between pull cords 86 or straps 66 when in a retracted orientation.

Figure 10:
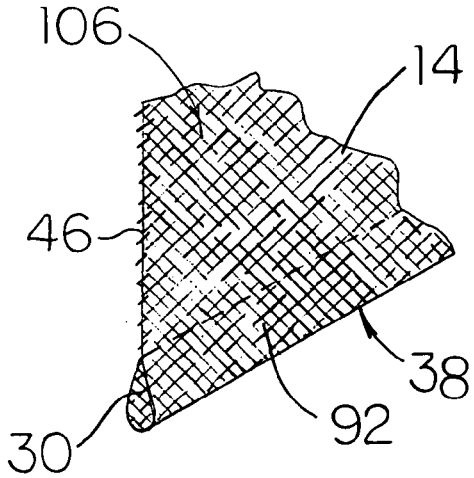
FIG. 10 illustrates a partial perspective view of one version of a hem.
Figure 11:
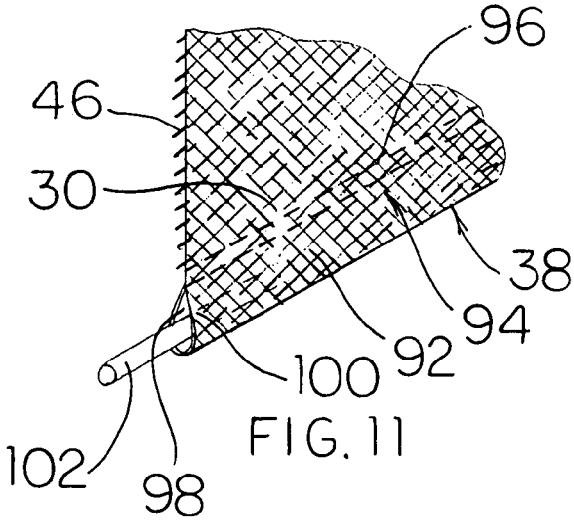
FIG. 11 illustrates a partial perspective view of another version of a hem, and having a rigid and/or weighted member being inserted into an open end of the hem.

Referring now to FIGS. 10 and 11, the footer 36 at the bottom edge 30 in one version comprises a hem 92. As shown in FIG. 10, a hem 92 may be formed by folding a portion of the screen panel 14 along the bottom edge 30 upwardly and securing it to a face 104, 106 of the screen panel 14 slightly above the bottom edge 30. Alternatively, as shown in FIG. 11, a hem 92 may be provided by securing a folded-over strip 94 of material to the bottom edge 30 at the distal edges 96 of the strip 94. In one version, the material for the strip 94 is generally a durable, flexible sheet-like material. As shown in FIGS. 10 and 11, a hem 92 may be provided with an opening 98 at one or both ends 100 so that a rigid and/or weighted member 102 such as a rod or dowel may be placed within the hem 92. The practical purposes for such a member 102 will be apparent to a person of ordinary skill in the art in light of this disclosure and the uses of the present invention.

A retractable screen 10 may be manufactured of various sizes and configurations to fit an opening 12 as desired. In one version for a garage door, the screen panel 14 has a height between about 78 inches and about 102 inches. In other versions, the height is about 7 feet. In yet other versions, the height is about 8 feet. In other versions for a garage door, the screen panel 14 has a width between about 7 feet and about 17 feet. In yet other versions, for a 2-car garage the width is about 16 feet. In yet other versions, for a one-car garage the width is about 8 feet. In yet other versions, for a one-car garage the width is about 9 feet.

Figure 12:
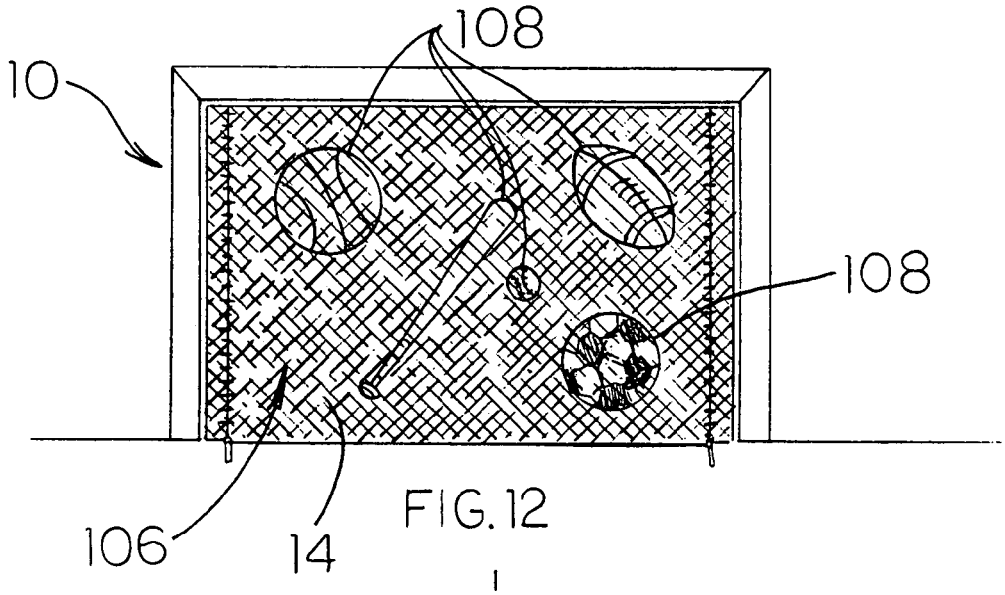
FIG. 12 illustrates a front view of another version of the retractable screen having an image display applied to the exterior face of the screen panel.
Figure 13:
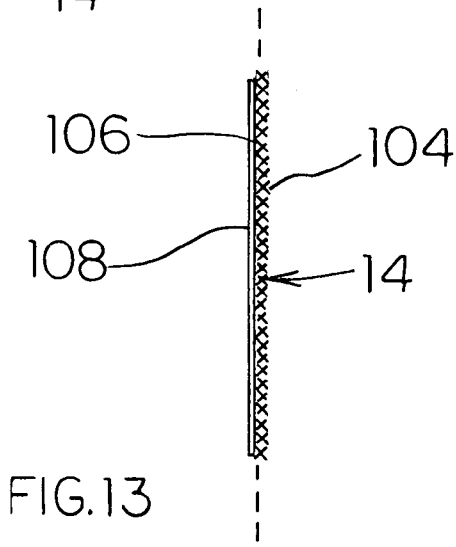
FIG. 13 illustrates a partial side view of a screen panel having an image display applied to an exterior face thereof.

Referring now to FIGS. 12 and 13, the screen panel 14 having an interior face 104 and an exterior face 106 may be provided with an image display 108 applied substantially on the exterior face 106. The actual image of the image display 108 may be any useful or ornamental image as desired by the user of the retractable screen 10. The image display 108 may be applied to the exterior face 106 by any suitable application method, such as by hand or machine painting, screen printing or decal, for example a porous or fibrous decal with a suitable adhesive backing for securing the decal to the screen panel 14. In one version, the image display 108 is configured to prevent a person from seeing through the screen 10 from the exterior face 106 side, but leaving the view, the passage of light, and the flow of air through the screen panel 14 substantially unobscured and/or impeded from the interior face 104 side.

For versions of the retractable screen 10 having an image display 108 applied to the screen panel 14, the screen panel 14 may comprise a removable portion 110, the image display 108 being applied substantially to the exterior face 106 of this removable portion 110. As a result, a user may have a plurality of removable portions 110 each having a different image display 108 applied thereto, such as is shown in FIG. 14, such that a plurality of image displays 108 can be exhibited at different times for a single retractable screen 10.

Figure 14:
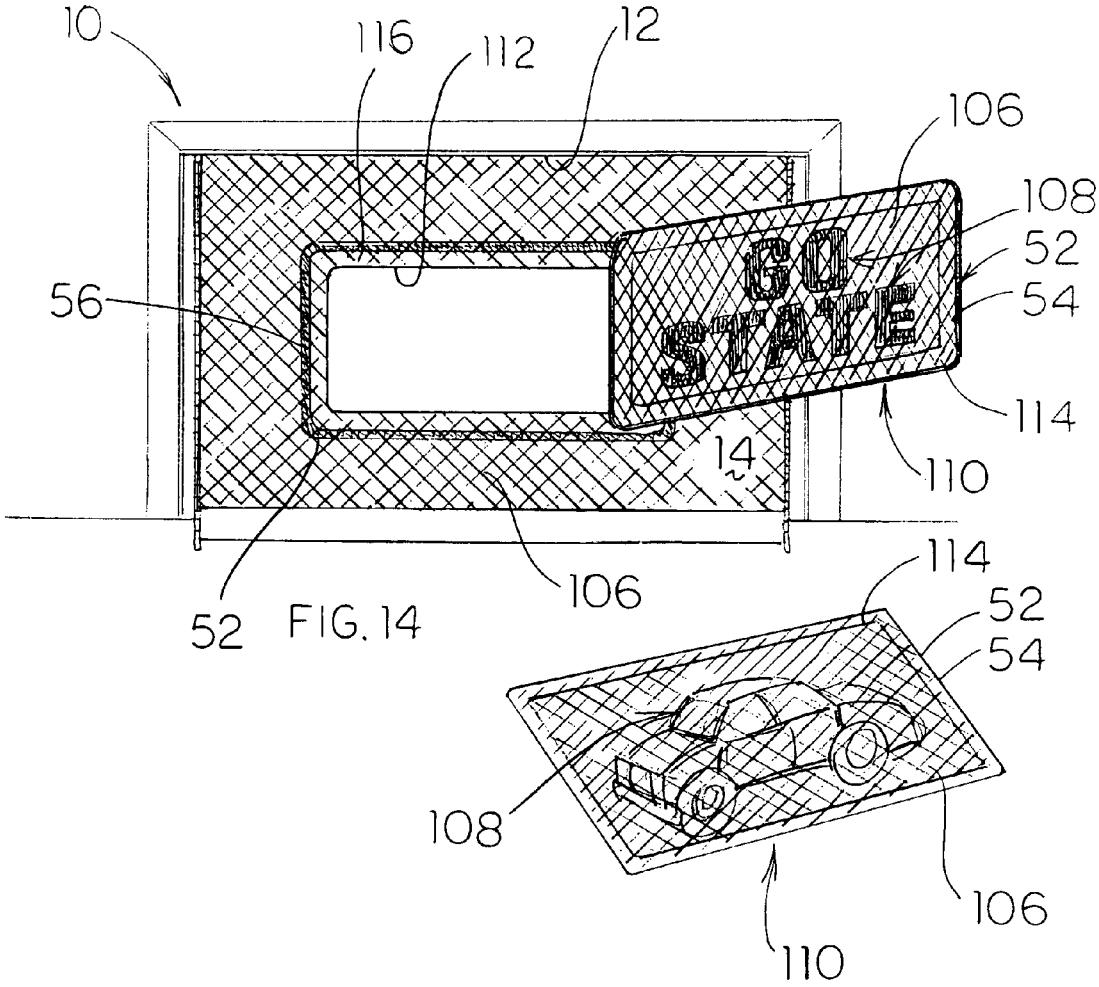
FIG. 14 illustrates a front view of another version of the retractable screen having removable portions of the screen panel with image displays applied the exterior face of each removable portion.

In one version as illustrated for example in FIG. 14, the removable portion 110 comprises a sheet the same or similar material as the screen panel 14 and is sized slightly larger than a corresponding aperture 112 in the screen panel 14. In other versions, a hook-and-loop fastener 52 secures the removable portion 110 about its peripheral edge 114 to the screen panel 14 proximate the periphery 116 of the aperture 112. In yet other versions, the peripheral edge 114 is secured to the periphery 116 using hooks, pins or other suitable fasteners 118 configured to avoid damaging the screening mesh material of the screen panel 14 and of the removable portion 110.

Figure 15A:
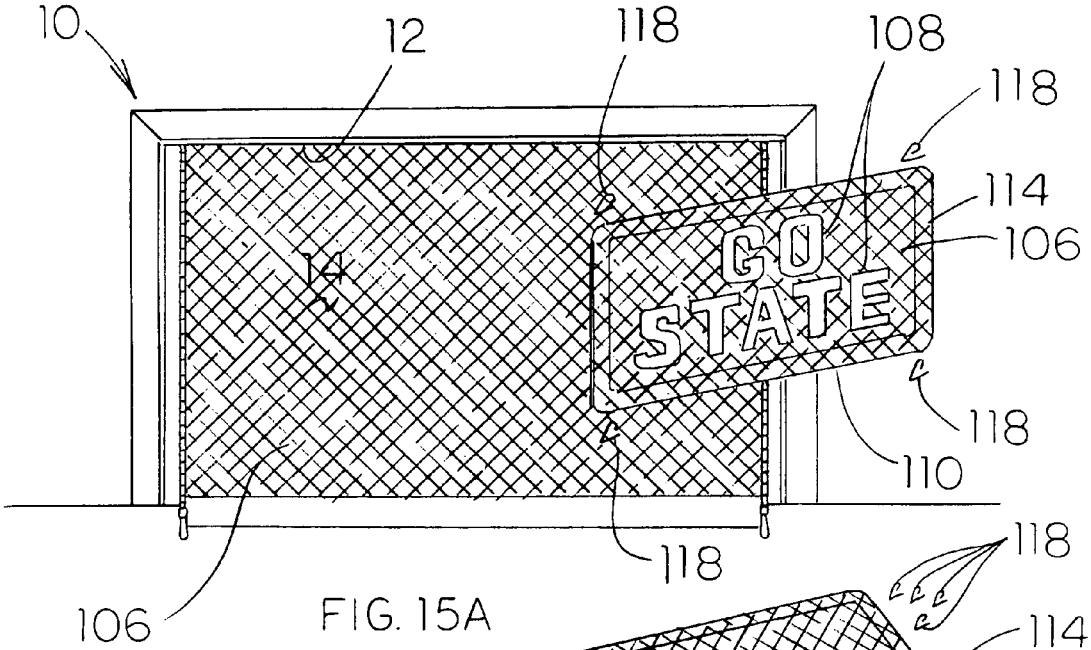
FIG. 15A illustrates a front view of another version of the retractable screen of FIG. 14 without the aperture in the screen panel.
Figure 15B:
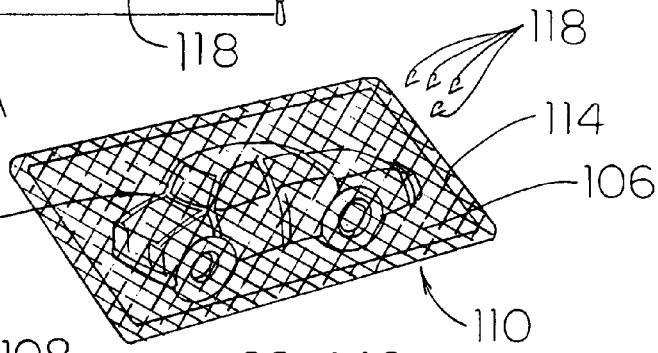
FIG. 15B illustrates a front view of another version of the retractable screen of FIG. 15A having a removable portion that hangs from the retention straps in front of the screen panel.
Figure 15B:
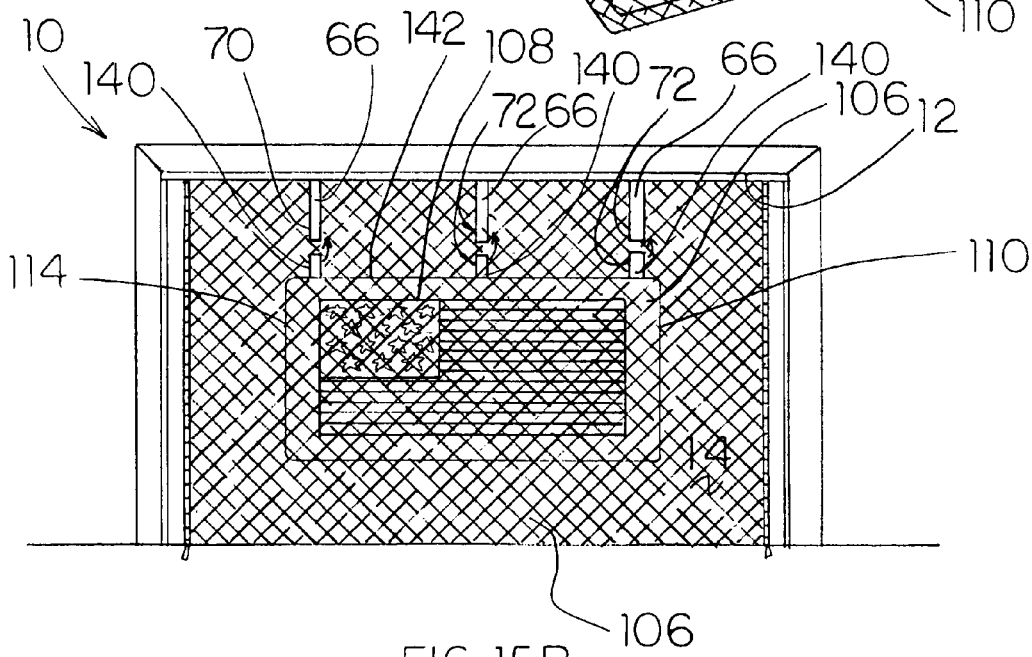

In an alternative version as illustrated for example in FIG. 15A, the removable portion 110 covers a portion of the screen panel 14 in a location as desired without an aperture 112. The removable portion 110 in such a version may be secured to the screen panel 14 using a hook-and-eye fastener 52, or hooks, pins or other suitable fasteners 118 that generally will not tend to damage the screening mesh material of the screen panel 14 or the periphery 114 of the removable portion 110. In other versions as illustrated for example in FIG. 15B, a removable portion 110 is mounted in front of the screen panel 14 instead of being attached thereto. In such versions, the removable portion 110 has straps 140 extending from the top 142 of the peripheral edge 114 and corresponding to at least two of the straps 66 with matching complimentary means 72 for securing distal ends 70 to the straps 140.

While several versions have been disclosed herein, it is to be understood that the versions and variations shown and described are merely illustrative of the principles of the invention and that various modifications may be implemented by those skilled in the art without departing from the scope and spirit of the invention and the claims appended hereto:

What is claimed is:

1. A retractable screen configured for mounting in a structural opening partially defined by a top member and first and second side members, said retractable screen comprising: a screen panel having a top edge, a bottom edge, and first and second side edges, said screen panel being generally configured for extending between first mounting means provided proximate said first and second side edges and second mounting means provided proximate said top edge, said first mounting means comprising first and second flexible mounting flaps each having an inner edge and an outer edge, each said inner edge being selectively connected to respective said first and second side edges by a zipper means, each said outer edge being configured for mounting on a surface of respective said first and second side members by a hook-and-loop fastener, one portion of said fastener being secured proximate to said outer edge substantially along said mounting flap, a complimentary portion of said fastener being provided on a strip secured to said surface substantially along said side member, said mounting flaps being adapted for flexible and resilient manipulation such that said inner edge and said outer edge are capable of being folded over on each other, said second mounting means comprising a top mounting border secured proximate said top edge and having one portion of a second hook-and-loop fastener secured substantially along said top mounting border for fastening to a complimentary portion provided on another strip secured to a surface substantially along said top member, said retractable screen further comprising a footer provided substantially along said bottom edge;

wherein said screen panel comprises an interior face and an exterior face, said exterior face having an image display applied thereto;

wherein said screen panel further comprises at least one removable portion, one said image display being applied generally to said exterior face of each of said removable portions, wherein a single retractable screen can be mounted having at least one of a plurality of possible image displays at any given time as desired; and wherein a said removable portion is mounted in front of said exterior face, said removable portion having a plurality of straps extending from an upper peripheral edge of said removable portion and corresponding to a plurality of retention straps secured proximate to said top mounting border and extending downwardly therefrom, each said strap and retention strap having a distal end having complimentary means for securing corresponding said distal ends together, and wherein said removable portion is resultingly suspended from said retention straps in front of said screen panel.

2. The retractable screen of claim 1 further comprising retention means configured to retain said screen panel in a retracted orientation proximate said top edge when said zipper means are unfastened to disconnect each said inner edge from respective said first and second side edges and said screen panel is retracted generally upwardly toward said top member.

3. The retractable screen of claim 2 wherein said retention means comprises a plurality of pairs of straps secured proximate to said top mounting border, said straps in each said pair comprising distal ends having complimentary means for securing said distal ends together with said screen panel in retracted orientation suspended between said straps.

4. The retractable screen of claim 3 wherein said complimentary means for securing said distal ends comprises a retention fastener selected from the group consisting of hook-and-loop fasteners, snaps, buttons, stem-and-eye buckles, snap-in buckles, and ties.

5. The retractable screen of claim 1 wherein said footer comprises a hem.

6. The retractable screen of claim 5 wherein said hem comprises a portion of said screen panel along said bottom edge folded upwardly and secured to said screen panel.

7. The retractable screen of claim 5 wherein said hem comprises a strip of a durable, flexible material folded back on itself and secured to said bottom edge at distal edges of said strip.

8. The retractable screen of claim 5 wherein said hem is open at one or both ends thereof, said hem being configured to receive a weighted member therein.

9. The retractable screen of claim 1 wherein said screen panel has a height between about 78 inches and about 102 inches.

10. The retractable screen of claim 9 wherein said height is about 7 feet or about 8 feet.

11. The retractable screen of claim 1 wherein said screen panel has a width between about 7 feet and about 17 feet.

12. The retractable screen of claim 11 wherein said width is about 16 feet.

13. The retractable screen of claim 11 wherein said width is about 8 feet or about 9 feet.

14. The retractable screen of claim 1 wherein said image display is applied to said exterior face by an application method selected from the group consisting of painting, screen printing and porous or fibrous adhesive decals.

15. The retractable screen of claim 1 wherein said screen panel has an aperture therein, each said removable portion being sized slightly larger than said aperture such that said aperture is completely covered by each of said removable portions, each of said removable portions being secured to said screen panel by a hook-and-loop fastener having one portion secured generally about the periphery of said aperture and a complimentary portion correspondingly secured about the periphery of each of said removable portions.

16. The retractable screen of claim 1 wherein said removable portions are secured to said screen panel in a location thereon as desired with a suitable fastener configured for avoiding damaging said screen panel and said removable portion.

17. The retractable screen of claim 2 wherein said retention means comprises a pulley system mounted proximate said top edge, said system configured to retract said screen panel generally upwardly.

18. The retractable screen of claim 17 wherein said system comprises a plurality of spaced apart pull cords secured proximate said bottom edge and extending wovenly upwardly toward said top edge through a plurality of generally aligned eyelets in said screen panel, a pulley being secured to said inwardly facing surface along said top member above each of said pull cords redirecting each of said pull cords generally perpendicularly toward a corner of said opening, a primary pulley being secured proximate to said corner and configured to receive each of said pull cords and redirect distal ends thereof generally downwardly.

19. The retractable screen of claim 18, further comprising a grommet provided in each said eyelet.

20. The retractable screen of claim 18 wherein said pulleys and said primary pulley comprises a roller pulley or an eye stem.

21. The retractable screen of claim 18, further comprising a plurality of transverse sleeves secured to a face of said screen panel and a rigid member removably inserted within each said sleeve.

22. The retractable screen of claim 21 wherein said pull cords are woven around said sleeves.

23. The retractable screen of claim 21 wherein said pull cords are woven through said sleeves but around a rigid member within each of said sleeves.

24. The retractable screen of claim 18 wherein said pull cords are maintained in a desired pulled-out position by being wrapped around a cleat secured proximate said opening.

25. The retractable screen of claim 18 wherein said pull cords are maintained in the desired pulled-out position by a set-friction brake provided at said primary pulley.

26. The retractable screen of claim 18 wherein said retention means further comprises a plurality of pairs of straps secured proximate to said top mounting border, said straps in each said pair having distal ends with complimentary means for securing said distal ends together with said screen panel in retracted orientation suspended between said straps.

* * * * *